US006019464A

United States Patent [19]

Tsukada et al.

[11] Patent Number: 6,019,464

[45] Date of Patent: Feb. 1, 2000

[54] INK JET RECORDING HEAD

[75] Inventors: Kenji Tsukada; Kazunaga Suzuki; Norihiko Kurashima, all of Nagano, Japan

[73] Assignee: Seiko Epson Corporation, Tokyo, Japan

[21] Appl. No.: 09/124,644

[22] Filed: Jul. 30, 1998

[30] Foreign Application Priority Data

Jul. 31, 1997 [JP] Japan ..... 9-206852

[51] Int. Cl.[7] ..... B41J 2/19

[52] U.S. Cl. ..... 347/92

[58] Field of Search ..... 347/85, 86, 87, 347/71, 92

[56] References Cited

U.S. PATENT DOCUMENTS 5,808,643 9/1998 Tracy et al. ..... 347/92

FOREIGN PATENT DOCUMENTS 587346 3/1994 European Pat. Off. .
695638 2/1996 European Pat. Off. .
719642 7/1996 European Pat. Off. .
855273 7/1998 European Pat. Off. .
6-234218 8/1994 Japan .
8-48030 2/1996 Japan .

*Primary Examiner*—N. Le
*Assistant Examiner*—Michael Nghiem
*Attorney, Agent, or Firm*—Sughrue, Mion, Zinn, Macpeak & Seas, PLLC

[57] ABSTRACT

An ink jet recording head is disclosed. The recording head comprises a reservoir for storing ink which is supplied into a plurality of pressure generating chambers arranged in a first direction, a slit-shaped air bubble guide groove communicated with the reservoir and extending in the first direction, an ink supply member communicating the air bubble guide groove with the pressure generating chambers, pressure generation unit for generating pressure to be applied to the ink in the pressure generating chambers, and a nozzle plate in which nozzle orifices in communication with the pressure generating chambers are formed for ejecting the ink pressurized by the pressure generation unit.

8 Claims, 6 Drawing Sheets

INK JET RECORDING HEAD

BACKGROUND OF THE INVENTION

1. Field of the Invention

The present invention relates to an ink jet recording head which records an image, such as characters, on a recording medium by ejecting ink droplets from a nozzle.

2. Description of Related Art

In general, in an ink jet recording head, a piezoelectric vibrating plate is affixed by adhesive to a part of a resilient plate comprising pressure generating chamber 6. The volume of the pressure generating chambers is changed by means of flexural displacements of the piezoelectric vibrating plate, thus ejecting ink droplets from a nozzle orifice. Such an ink jet recording head enables displacement of a wide area of the pressure generating chamber and hence is characterized by the stable ejection of ink droplets.

For example, as shown in FIG. 8, a conventional ink jet recording head includes an actuator unit which is formed by stacking up a resilient plate 113, a pressure generating chamber formation member 112, and a closure member 111, in this order from the top. The resilient plate 113 has a piezoelectric vibrating plate 117 placed thereon, thus constituting a vibration member. The pressure generating chamber formation member 112 forms a pressure generating chamber 115, one surface of which is sealed by the resilient plate 113. The closure member 111 seals the other surface of the pressure generating chamber 115 and has a supply communication path 122 for connecting the pressure generating chamber 115 to a supply hole 126 and a communication hole 120 for connecting the pressure generating chamber 115 to a nozzle orifice 121. A channel unit is formed by stacking up a supply hole formation substrate 124 having the supply hole 126 formed therein, a reservoir formation plate 123, and a nozzle plate 130, in this order from the top. The reservoir formation plate 123-has a reservoir 125, one surface of which is sealed by the supply hole formation substrate 124 and which is in communication with the pressure generating chamber 115 by way of the supply hole 126, and a communication hole 128 for connecting a nozzle orifice 121 to the pressure generating chamber 115. The nozzle plate 130 has the nozzle orifice 121 and seals the other surface of the reservoir formation plate 123. The ink jet recording head is formed by placing the foregoing actuator unit on the channel unit and bonding them together through use of an adhesive.

In such an ink jet recording head, if air bubbles remain in an ink flow channel, the air bubbles hinder ink supply or absorb pressure to eject ink, thus causing ink ejecting failures. Such air bubbles remain in the ink flow channel when the head is replenished with ink from an ink cartridge for the first time. In other cases, air bubbles enter the recording head from a connected portion between the head and the ink cartridge when the empty ink cartridge is replaced with a new ink cartridge. Alternatively, an ink meniscus in a nozzle is fractured by vibration, thus permitting entry of air bubbles into the recording head from the nozzle orifice. Thus a eliminator for these air bubbles is necessary in the ink jet recording apparatus. In general, there is provided a pump in the conventional recording apparatus. At the time of replacement of an ink cartridge or in the event of an ink ejecting failure, ink is forced out of the recording apparatus from the nozzle orifice by actuation of the pump, thereby producing an outflow for removing air bubbles.

However, the aforementioned conventional ink jet recording head suffers from inefficient discharge of air bubbles and a problem of air bubbles being likely to remain in corner portions of the ink flow channel as indicated by X and Y in FIG. 8 occurs. If the supply hole 126 is positioned close to the side wall of the supply communication path 122, air bubbles are urged to leave. However, increasing the positional accuracy of a bonding plane between the actuator unit and the channel unit is difficult. An adhesive squeezed along the bonding plane may fill the supply hole 126.

SUMMARY OF THE INVENTION

The object of the present invention is to provide an ink jet recording head which efficiently discharges air bubbles.

Another object of the present invention is to provide an ink jet recording head having a supply hole for supplying ink to a pressure generating chamber from a reservoir, which is provided with high positional accuracy.

To achieve the above object, according to the present invention, there is provided an ink jet recording head comprising: a reservoir for storing ink which is supplied into a plurality of pressure generating chambers arranged in a first direction; a slit-shaped air bubble guide groove communicating with the reservoir and extending in the first direction; an ink supply member communicating the air bubble guide groove with the pressure generating chambers; pressure generation means for generating pressure to be applied to the ink in the pressure generating chambers; a nozzle plate in which nozzle orifices communicated with the pressure generating chambers are formed for ejecting the ink pressurized by the pressure generation means.

In the unit, the slit-shaped air bubble guide groove is formed between the reservoir and the ink-supply holes in a direction in which the plurality of pressure generating chambers are arranged. Accordingly, air bubbles contained in the reservoir are guided and moved along the air bubble guide groove, thus enabling efficient discharge of air bubbles.

In the unit, the ink supply member includes a plurality of ink supply holes, and each of the pressure generating chambers communication with the air bubble guide groove by the plurality of ink supply holes. In addition, each of the ink supply holes is positioned in the vicinity of a side wall of the air bubble guide groove and in the vicinity of a side wall of the respective pressure generating chamber.

Accordingly, the air bubbles are urged to leave corner portions in the vicinity of the entrance of exit of the supply holes, and thus air bubbles remaining in the recording head can be prevented.

In the unit, a diameter of the each ink supply hole becomes greater toward the reservoir.

Accordingly, an ink flow produced by the pressure developed in the pressure generating chambers is prevented from escaping into the reservoir by way of the ink supply holes. Further, air bubbles remaining in corner portions of the flow channel can be reduced.

In the unit, a width of the air bubble guide groove becomes greater toward the reservoir.

Accordingly, the air bubbles contained in the reservoirs can be quickly discharged by way of the ink supply holes.

In the unit, the pressure generation means is an actuator unit including: a resilient plate; a piezoelectric vibrating element provided on the resilient plate; a pressure generating chamber formation member for forming the pressure generating chambers in such a way that one end face of the each pressure generating chamber is sealed by the resilient plate; and an ink supply hole formation substrate which seals the other end face of the each pressure generating chamber, the ink supply hole formation substrate having the ink supply holes in one end portion thereof with respect to a second direction perpendicular to the first direction, wherein the piezoelectric element, the resilient plate, the pressure generating chamber formation member and the ink supply hole formation substrate are integrally formed.

Accordingly, the positional accuracy of the ink supply holes can be improved. Furthermore, reduction in the manufacturing cost can be enabled.

DETAILED DESCRIPTION OF THE PREFERRED EMBODIMENTS

Preferred embodiments of the present invention will be described in detail by reference to the accompanying drawings.

Figure 2:
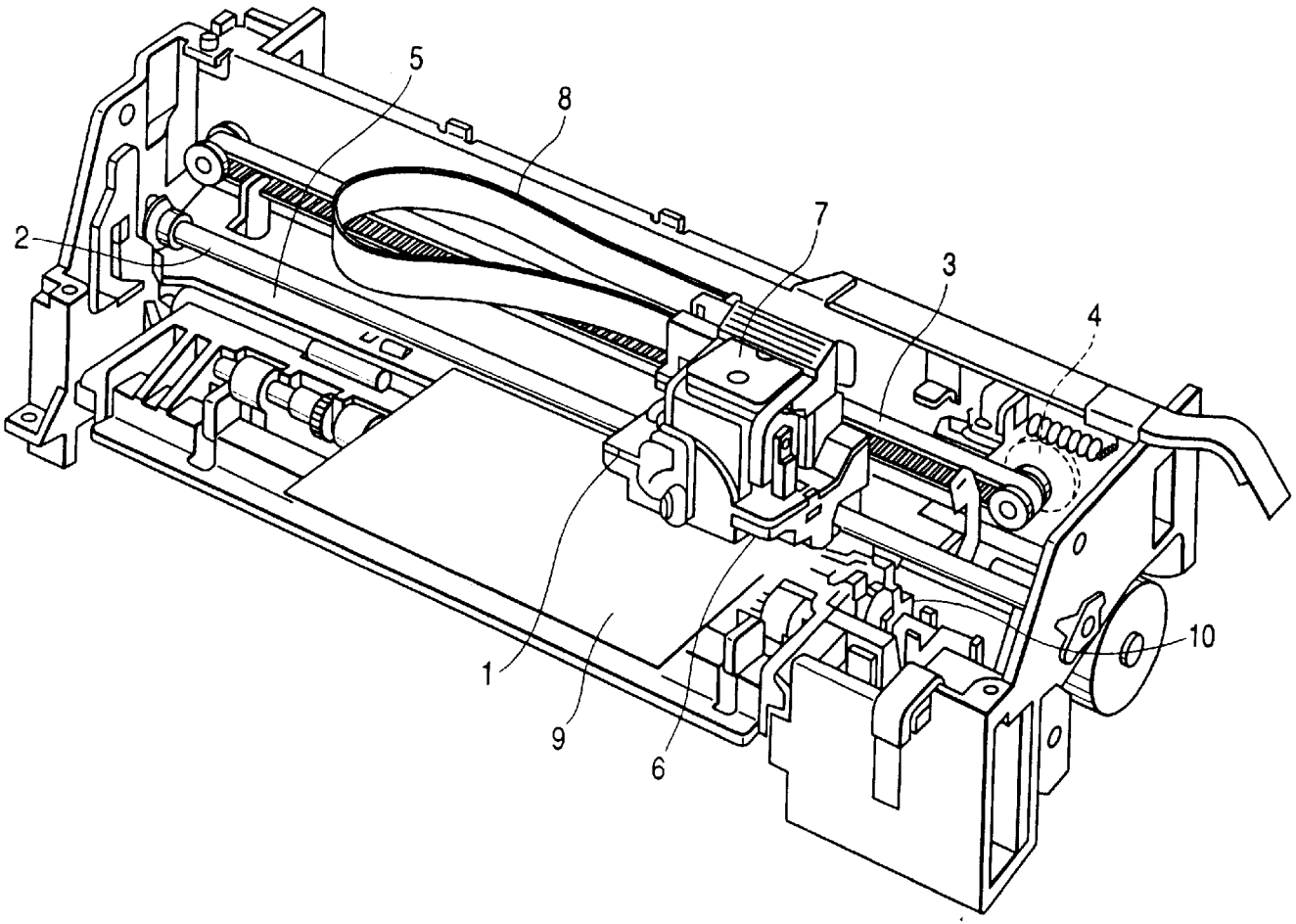
FIG. 2 is a view showing one embodiment of an ink jet printer to which the present invention is applied.

FIG. 2 shows one embodiment of an ink jet printer which uses an ink jet head recording head according to the present invention. A carriage 1 is supported on a guide member 2 so as to be movable back and forth. The carriage 1 is provided so as to be movable back and forth in parallel with a platen 5 by means of a timing belt 3 connected to a stepping motor 4.

An ink jet recording head 6 is removably attached to a lower face of the carriage 1, and a print unit 7 is removably attached to an upper face of the same. Ink is ejected from the recording head 6 in response to a drive signal transmitted via a flexible cable 8, whereby characters or an image are (is) printed on a recording sheet 9. During a non-printing condition, the recording head 6 is sealed by a capping means 10.

Figure 3:
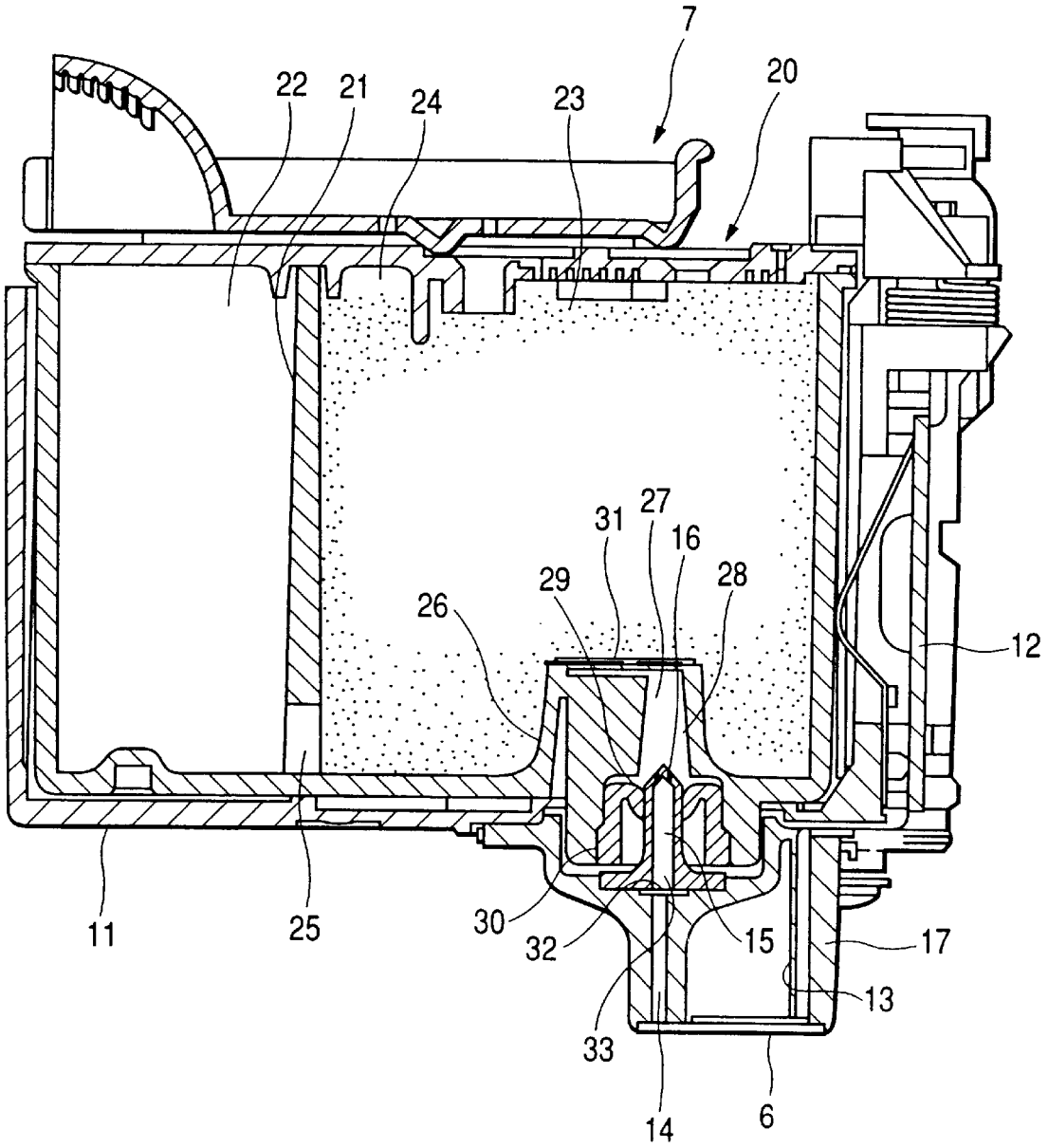
FIG. 3 is a section view showing one embodiment of a print unit which includes the ink jet recording head according to the present invention.

As shown in FIG. 3, the foregoing print unit 7 comprises a holder 11 mounted on the carriage 1, and an ink cartridge 20 which is to be housed in the holder 11 as an ink holding member. The ink jet head 6 is provided on a lower face of the holder 11 so as to face the recording paper 9.

By means of the flexible cable 13, the recording head 6 is connected to a terminal plate 12 which is electrically removably connected to a terminal (not shown) provided on the carriage 1 connected to the flexible cable 8 of the printer body.

The inside of the ink cartridge 20 is partitioned into two subdivisions, that is, an ink chamber 22 for holding ink as is and a foam chamber filled with a porous foam material, by means of a wall 21. These chambers are in communication with each other by way of a connection hole 25 formed below the wall 21.

A protuberance 26 is formed on the bottom face of the foam chamber 24 so as to press the bottom face of the foam material 23. A connection hole 27 is formed in the protuberance 26, thus constituting an ink flow channel. A first filter plate 31 is provided on the upper end of the connection hole 27, and an ink supply port 28 is provided on the lower end of the protuberance 26 so as to receive an ink feed needle 16, which will be described later.

The holder 11 is provided with the ink feed needle 16. The upper end of the ink feed needle 16 is formed in the shape of a needle so as to pass through a seal 29 sealing the ink supply port 28 of the ink cartridge 20 and to fit into a packing 30. In the lower end of the ink feed needle 16 there is formed a connection hole 15 to be connected to an ink flow channel 14 that is in connection with the recording head 6.

In the present embodiment, a filter chamber 33 comprising a second filter 32 as shown in FIG. 3 is formed in an ink flow channel between the lower end of the ink feed needle 16 and the ink flow channel 14 connected to the recording head 6.

When the ink is expended during a printing operation by the recording head 6, the ink absorbed in the foam material 23 of the cartridge 20 is sucked out by the recording head 6. After dust or dirt contained in the ink has been eliminated by the filter plate 32, the ink flows into the recording head 6.

Figure 1:
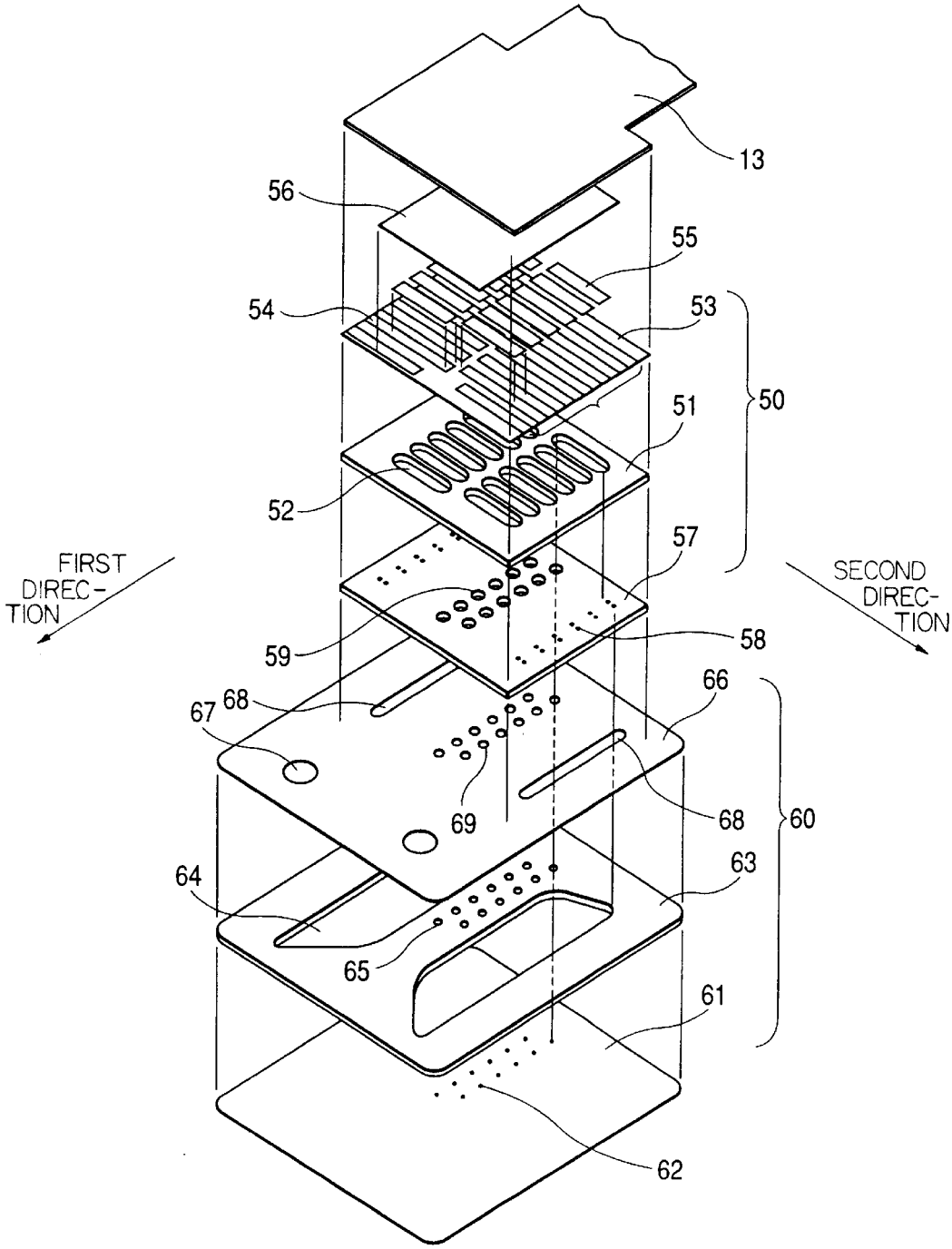
FIG. 1 is an exploded perspective view showing a piezoelectric vibrator unit for an ink jet recording head according to the present invention.
Figure 4:
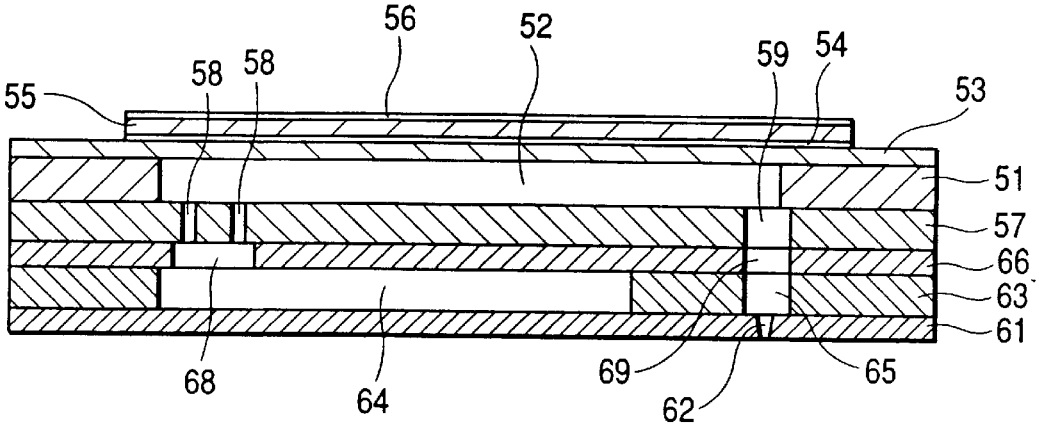
FIG. 4 is a section view showing the ink jet recording head according to one embodiment of the present invention.

FIG. 1 is an exploded perspective view showing one embodiment of a piezoelectric vibrator unit for the ink jet recording head 6 according to the present invention. FIG. 4 is a section view. Pressure generation chambers 52 are formed in two rows in a pressure generating chamber formation substrate 51. One surface of the pressure generating chamber formation substrate 51 is sealed with a vibration plate 53. Lower electrodes 54 separated from each other are formed on the surface of the vibration plate 53 so as to correspond to the respective pressure generating chambers 52. Piezoelectric vibrators 55 are formed on the surface of the lower electrodes 54. An upper electrode 56 is formed on the surface of the piezoelectric vibrators 55 so as to extend over the vibrators 55.

A supply hole formation substrate 57 is formed on the other surface of the pressure generating chamber formation substrate 51. In the supply hole formation substrate 57, there are formed supply holes 58 for supplying ink to one end of the pressure generating chambers 52 from common ink chambers or reservoirs 64, and connection holes 59 for connecting the other end of the pressure generating chambers 52 to respective nozzle orifices 62.

The vibration plate 53, the pressure generating chamber formation substrate 51, and the supply hole formation substrate 57 are formed from a ceramic plate such as zirconia ($ZrO_2$) or the like. The actuator unit 50 is formed integrally by firing the plate and substrates. Since the supply holes 58 are formed in the integrally-fired actuator unit 50, the positional accuracy of the supply holes 58 can be improved. Further, integral formation of the actuator unit results in an advantage of cost reduction.

A channel unit 60 is formed by stacking a nozzle plate 61 made of metallic material, a reservoir formation substrate 63, and an ink inlet hole formation substrate 66. The nozzle orifices 62 for ejecting ink stored in the pressure generating chamber 52 are formed in the nozzle plate 61. In the reservoir formation substrate 63, there are formed common ink chambers 64 which receive the ink supplied from the ink cartridge and store the ink to be supplied to a plurality of pressure generating chambers 52 and connection holes 65 for connecting the pressure generating chambers 52 to the respective nozzle orifices 62.

In the ink inlet hole formation substrate 66, there are formed ink inlet holes 67 for supplying ink to the reservoir 64 from the ink cartridge, air bubble guide grooves 68 which are formed into slits so as to connect the reservoirs 64 to the supply holes 58 in a direction in which the supply holes 58 are arranged, and connection holes 69 for connecting the pressure generating chambers 52 to the nozzle orifices 62.

In one actuator unit 50, two rows of pressure generating chambers 52 are formed in such a way that the pressure generating chambers of one row and those of another row are displaced from one another by only half the pitch of the pressure generating chambers in a direction in which they are arranged. Similarly, the corresponding nozzle orifices 62 are arranged into two rows in such a way that the nozzle orifices of one row and those of another row are displaced from one another by only half the pitch of the nozzle orifices in a direction in which they are arranged. Accordingly, when viewed in the primary scanning direction, the nozzle orifices appear to be arranged at half the pitch at which the pressure generating chambers are arranged, thus substantially doubling the nozzle density.

In the present embodiment, the supply holes 58 are arranged in such a way that two supply holes 58 correspond to one pressure generating chamber 52. The supply holes 58 are provided in the vicinity of the side surface of the pressure generating chamber 52 and in the vicinity of the side wall of the air bubble guide groove 68, thus urging air bubbles to leave corner portions in the vicinity of the entrance or exit of the supply holes 58, thus preventing air bubbles from remaining in the recording head.

In the present embodiment, ink is supplied to the two rows of reservoirs 64 from the two ink inlet holes 67. However, so long as the two rows of reservoirs 64 are brought into communication with each other, the ink inlet holes 67 can be reduced in number to one.

Figure 5:
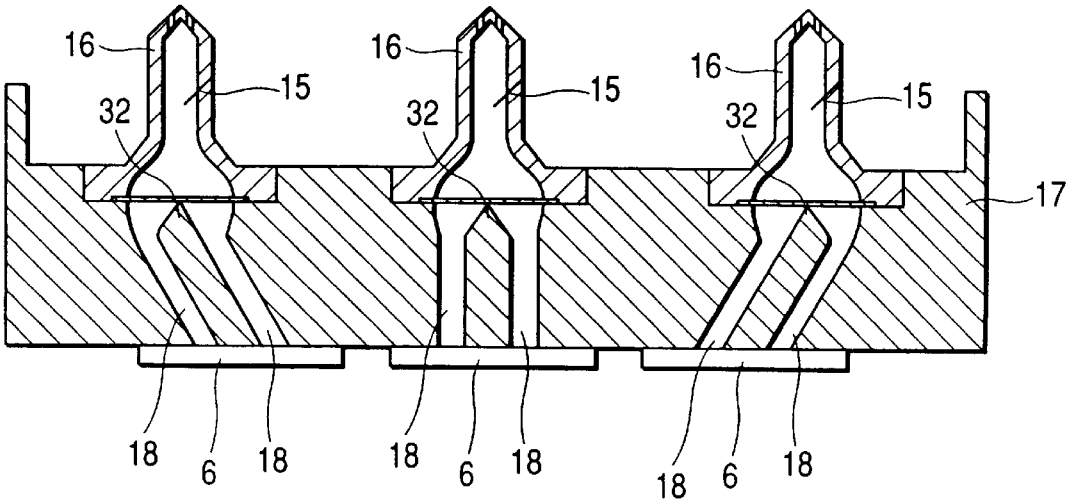
FIG. 5 is a section view showing one embodiment of an ink supply channel connecting a color-ink cartridge to the recording head according to the present invention.

FIG. 5 shows one embodiment of a color recording head in which the foregoing recording heads 6 are attached to a common head frame 17. An ink cartridge is partitioned into a plurality of segments for storing ink of different colors independently of one another. The connection holes 15 of the ink feed needles 16 extend from the segments of the ink cartridge so as to connect to the recording heads 6.

In contrast, in the head frame 17 to be connected to the connection holes 15 of the ink feed-needles 16 which supply ink to the recording heads 6, two connection holes 18 are formed in each recording head 6 so that ink can be supplied to the two ink inlet holes 67 independently of each other.

The filter chamber 33 is formed in a node where the connection hole 15 is connected to the two connection holes 18, and the second filter 32 is provided in the filter chamber 33.

At the time of a printing operation, a voltage is applied to the piezoelectric vibrators 55, so that the piezoelectric vibrators 55 become constricted in a horizontal direction. Accordingly, the vibration plate 53 becomes warped and deformed in such a direction as to constrict the pressure generating chambers 52, thereby producing pressure in the pressure generating chambers 52. Under this pressure, an ink flow arises from the pressure generating chambers 52 to the nozzle orifices 62 by way of the connection holes 59, 69, and 65, thereby ejecting ink droplets from the nozzle orifices 62.

FIGS. 6(A) to 6(D) are schematic illustrations showing discharge of air bubbles from the inside of the reservoir of the ink jet recording head according to the present invention.

Figure 6A:
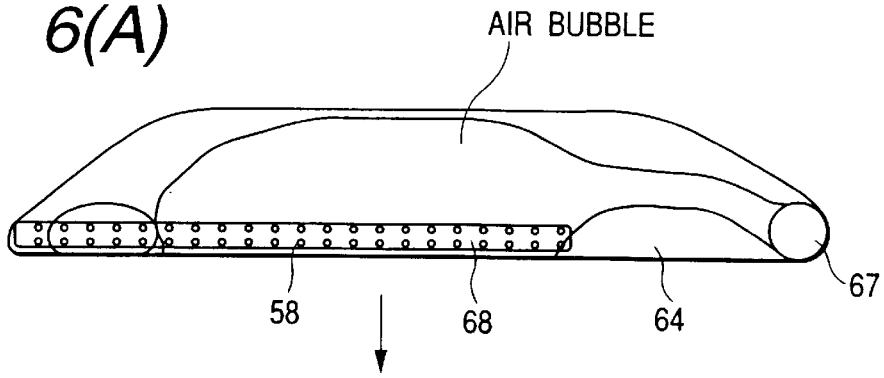
FIGS. 6(A) to 6(D) are schematic illustrations showing discharge of air bubbles from the inside of the reservoir by way of supply holes according to the embodiment.

As a result of actuation of a cleaning pump, the air bubbles, which entered the connection hole 15 at the time of removal or attachment of an ink cartridge from or to the recording head, are delivered to the reservoir 64 by way of the ink inlet hole 67 together with ink. As shown in FIG. 6(A), the air bubbles that entered the reservoir 64 from the ink inlet hole 67 are first guided to the air bubble guide groove 68.

Figure 6B:
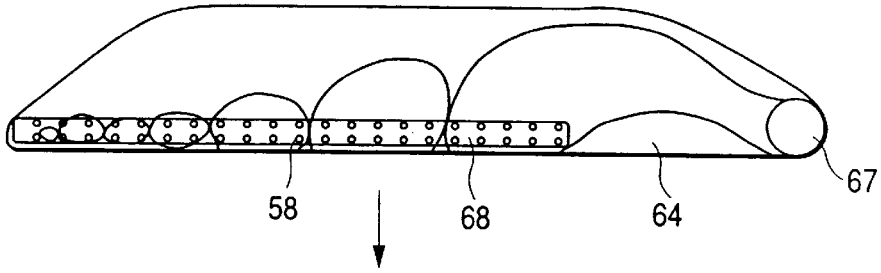
Figure 6C:
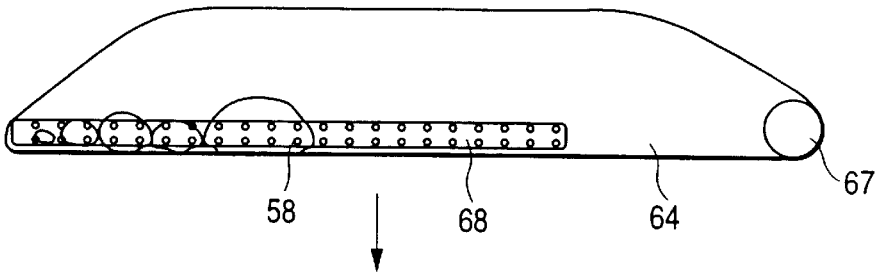
Figure 6D:
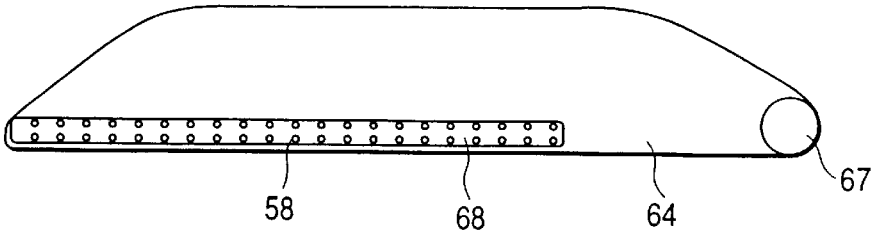

Next, as shown in FIG. 6(B), the air bubbles guided to the air bubble guide groove 68 move along the air bubble guide groove 68. In the present embodiment, the two supply holes 58 are provided so as to correspond to each of pressure generating chambers 52. Since the supply holes 58 are provided in the vicinity of the side walls of the pressure generating chambers 52 and in the vicinity of the side walls of the air bubble guide grooves 68, air bubbles are urged to leave corner portions in the vicinity of the entrance and exit of the supply holes 58, thus preventing air bubbles from remaining in the reservoir 64. The air bubbles are discharged to the pressure generating chambers 52 by way of the supply holes 58 and gradually become smaller as shown in FIG. 6(C). Finally, as shown in FIG. 6(D), the discharge of air bubbles is completed.

Figure 7:
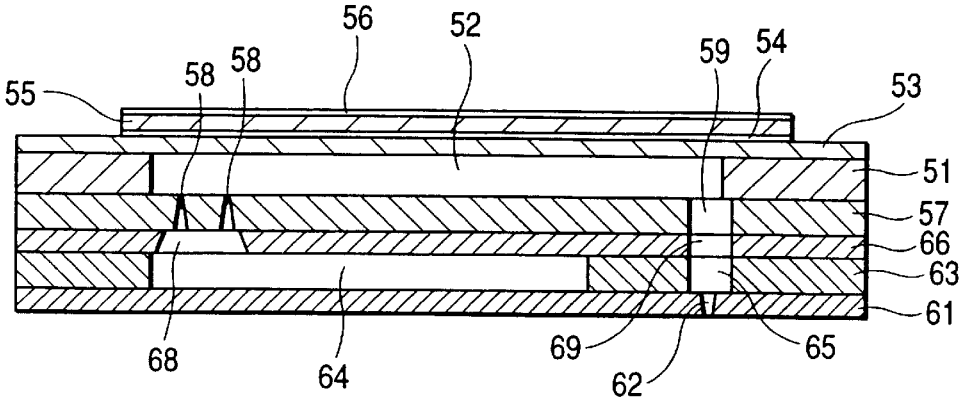
FIG. 7 is a section view showing an ink jet recording head according to another embodiment of the present invention.
Figure 8:
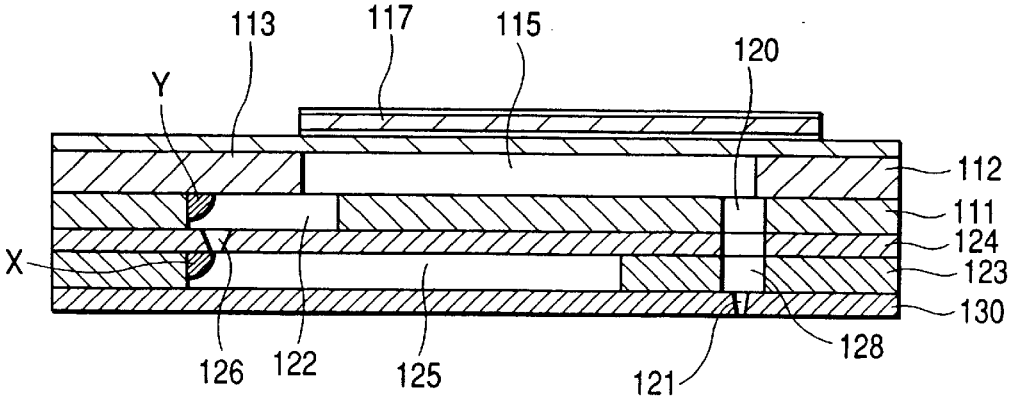
FIG. 8 PRIOR ART
FIG. 8 is a section view showing an conventional ink jet recording head.

FIG. 7 is a section view showing another embodiment of the present invention. The air bubble guide grooves 68 become greater in width toward the reservoir 64, so that the air bubbles contained in the reservoir 64 are likely to be guided, thus enabling quick discharge of air bubbles from the supply holes 58. In the embodiment, the supply holes 58 are tapered in such a way as to become smaller in diameter toward the pressure generating chamber 52 and become greater in diameter toward the reservoir 64. As a result, an ink flow caused by the pressure applied by the pressure generating chambers 52 can be prevented from escaping into the reservoirs 64 by way of the supply holes 58. Further, air bubbles can be prevented from remaining in corner portions of a flow channel.

What is claimed is:

1. An ink jet recording head comprising:

a reservoir for storing ink which is supplied into at least one of plural pressure generating chambers arranged in a first direction;

a slit-shaped air bubble guide groove communicated with the reservoir and extending in the first direction;

an ink supply member communicating the air bubble guide groove with the pressure generating chambers through ink supply holes formed in said ink supply member;

pressure generator which generates pressure to be applied to the ink in the pressure generating chambers; and a nozzle plate in which nozzle orifices in communication with the pressure generating chambers are formed for ejecting the ink pressurized by the pressure generator.

2. The ink jet recording head as set forth in claim 1, wherein the ink supply member includes a plurality of ink supply holes, and each of the pressure generating chambers is in communication with the air bubble guide groove by the plurality of ink supply holes.

3. The ink jet recording head as set forth in claim 2, wherein each of the ink supply holes is positioned in the vicinity of a side wall of the air bubble guide groove.

4. The ink jet recording head as set forth in claim 2, wherein each of the ink supply holes is positioned in the vicinity of a side wall a respective pressure generating chamber.

5. The ink jet recording head as set forth in claim 2, wherein a diameter of the each ink supply holes becomes greater toward the reservoir.

6. The ink jet recording head as set forth in claim 2, wherein the pressure generator means is an actuator unit including:

a resilient plate;

a piezoelectric vibrating element provided on the resilient plate;

a pressure generating chamber formation member for forming the pressure generating chambers in such a way that one end face of each pressure generating chamber is sealed by the resilient plate; and an ink supply hole formation substrate which seals the other end face of the each pressure generating chamber, the ink supply hole formation substrate having the ink supply holes in one end portion thereof with respect to a second direction perpendicular to the first direction, wherein the piezoelectric element, the resilient plate, the pressure generating chamber formation member and the ink supply hole formation substrate are integrally formed.

7. The ink jet recording head as set forth in claim 1, wherein a width of the air bubble guide groove measured along a second direction perpendicular to the first direction becomes greater toward the reservoir so that a widened portion of said air bubble guide groove faces the reservoir.

8. The ink jet recording head according to any one of claims 1–7, further comprising a plurality of slit-shaped air bubble guide grooves which extend parallel to each other.

* * * * *